US008245601B1

(12) United States Patent
Hastama et al.

(10) Patent No.: US 8,245,601 B1
(45) Date of Patent: Aug. 21, 2012

(54) SCREWDRIVER SLEEVE FINDER

(75) Inventors: Lie Dhani Hastama, Petaling Jaya (MY); Keen Leong Chew, Selangor (MY); Lim Song Chong, Selangor (MY); Sie Cheang Phuah, Subang Jaya (MY)

(73) Assignee: Western Digital Technologies, Inc., Irvine, CA (US)

( * ) Notice: Subject to any disclaimer, the term of this patent is extended or adjusted under 35 U.S.C. 154(b) by 331 days.

(21) Appl. No.: 12/752,006

(22) Filed: Mar. 31, 2010

(51) Int. Cl.
*B25B 23/08* (2006.01)

(52) U.S. Cl. ..... 81/55; 81/52

(58) Field of Classification Search ..... 81/52, 54, 81/55, 57.37; 29/418, 428, 407.02, 407.04, 29/525.11, 743
See application file for complete search history.

(56) References Cited

U.S. PATENT DOCUMENTS

| | | | | |
|---|---|---|---|---|
| 3,583,451 | A | 6/1971 | Dixon et al. | |
| 4,495,841 | A | 1/1985 | Mori et al. | |
| 4,627,316 | A | 12/1986 | Mori et al. | |
| 4,922,436 | A | 5/1990 | Dohm et al. | |
| 4,924,732 | A | 5/1990 | Hoskins et al. | |
| 5,090,103 | A | 2/1992 | Nakata et al. | |
| 5,480,087 | A | 1/1996 | Young et al. | |
| 6,418,818 | B1 | 7/2002 | Tham et al. | |
| 6,681,659 | B2 | 1/2004 | Hoe et al. | |
| 6,701,812 | B1 | 3/2004 | Sawamura | |
| 6,945,140 | B2 | 9/2005 | Gibbons et al. | |
| 7,178,432 | B1 | 2/2007 | Han et al. | |
| 7,549,204 | B1 | 6/2009 | Vangal-Ramamurthy et al. | |
| 7,661,335 | B2 * | 2/2010 | Kuboyama | 81/54 |
| 7,930,955 | B2 * | 4/2011 | Miyamoto | 81/54 |
| 7,963,194 | B2 * | 6/2011 | Miyamoto | 81/54 |
| 7,997,164 | B2 * | 8/2011 | Miyamoto | 81/52 |
| 2005/0039580 | A1 | 2/2005 | Gibbons et al. | |
| 2008/0115628 | A1 * | 5/2008 | Shirai et al. | 81/55 |
| 2008/0314197 | A1 | 12/2008 | Honma | |
| 2008/0314204 | A1 | 12/2008 | Kuboyama | |
| 2010/0326241 | A1 * | 12/2010 | Miyamoto | 81/54 |
| 2010/0326242 | A1 * | 12/2010 | Miyamoto | 81/54 |

* cited by examiner

*Primary Examiner* — David B Thomas

(57) ABSTRACT

A screwdriver sleeve finder comprises a sleeve, a fastener stop, purge channels, and ports. The sleeve is mountable on a screwdriver around a bit for driving a threaded fastener. The fastener stop is disposed within the sleeve between a forward bore and a rearward bore, and defines, between the rearward bore and the forward bore, an axial path for the bit to engage the threaded fastener and an evacuation path. The purge channels are defined within sidewalls of the sleeve, and the ports are disposed in the sidewalls of the sleeve to fluidly couple respective ones of the purge channels to the forward bore. The sleeve may be coupled to a compressed gas source for supplying compressed gas into the forward bore via the purge channels and ports, and to a vacuum source for evacuating particles within the forward bore via the evacuation path and the rearward bore.

23 Claims, 6 Drawing Sheets

SCREWDRIVER SLEEVE FINDER

BACKGROUND

Hard disk drives (HDDs) contain many components from which working gaps are formed between the components. As HDDs are made with higher capacity and more precision, the size of the components and the working gaps increasingly become smaller. Contaminant particles may interfere with the HDD components and the working gaps, which can result in HDD failure. It is therefore beneficial to minimize the amount of contaminant particles the HDDs are exposed to, particularly during the assembly process of the HDDs.

BRIEF DESCRIPTION OF THE DRAWINGS

The accompanying drawings, which are included to provide further understanding of the subject disclosure and are incorporated in and constitute a part of this specification, illustrate aspects of the subject disclosure and together with the description serve to explain the principles of the subject disclosure.

DETAILED DESCRIPTION

In the following detailed description, numerous specific details are set forth to provide a full understanding of the subject disclosure. It will be apparent, however, to one ordinarily skilled in the art that the subject disclosure may be practiced without some of these specific details. In other instances, well-known structures and techniques have not been shown in detail so as not to obscure the subject disclosure.

Screwdrivers are typically used to assemble HDDs. For example, screwdrivers may be used to drive threaded fasteners, such as screws, for fastening various HDD components together. However, abrasion between the screwdrivers and the threaded fasteners and/or abrasion between the threaded fasteners and the HDD components may result in contaminant particles being generated from the screwdrivers, threaded fasteners and/or the HDD components. The contaminant particles may interfere with the HDD components, resulting in HDD failure. Thus, it is desirable to dispose of the contaminant particles generated while driving threaded fasteners with screwdrivers.

Figure 1:
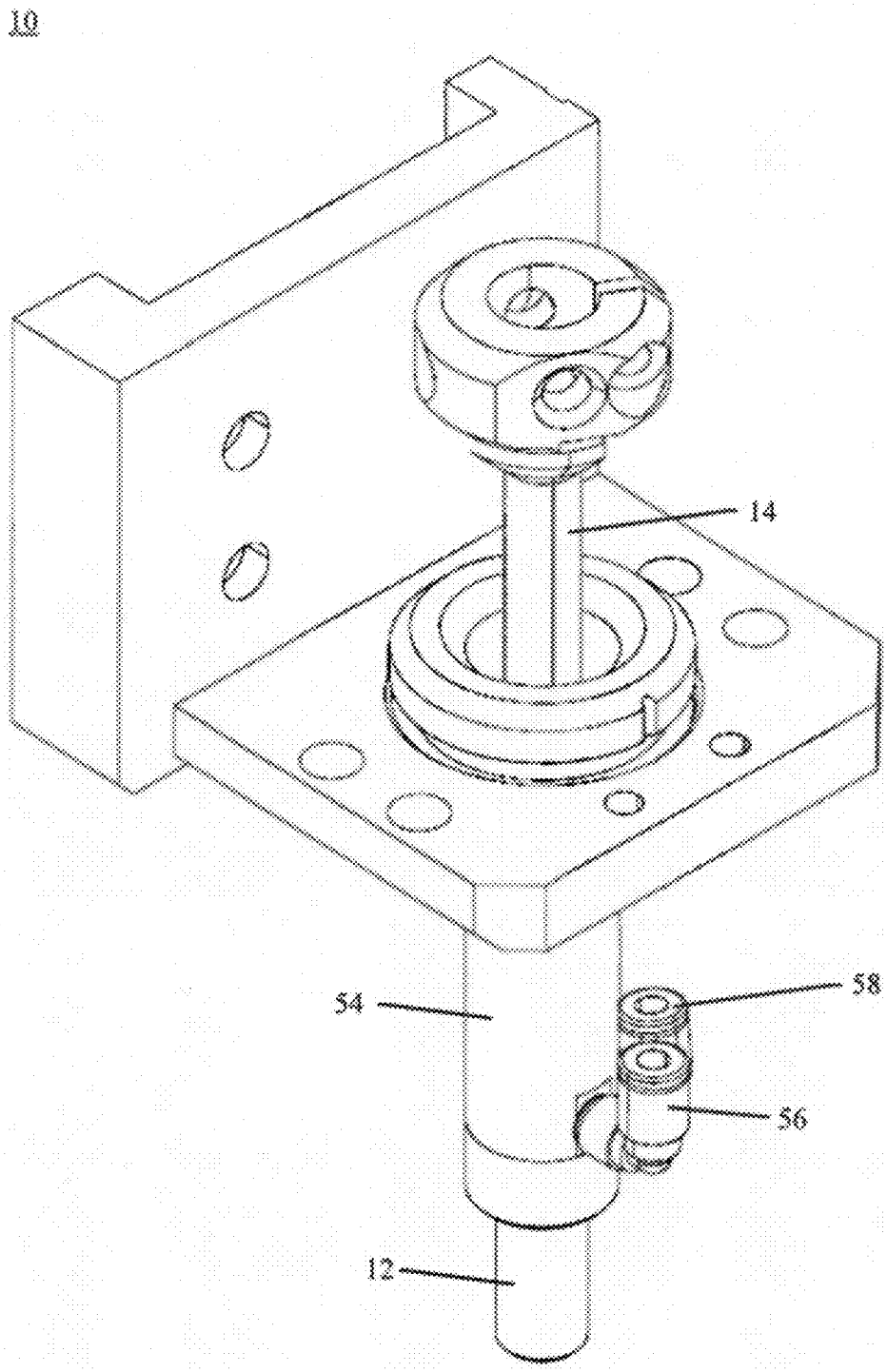
FIG. 1 illustrates an example of a screw driving system, in accordance with various aspects of the subject disclosure.

FIG. 1 illustrates an example of screw driving system 10, in accordance with various aspects of the subject disclosure. Screw driving system 10 comprises housing 54, screwdriver 14, screwdriver sleeve finder 12, vacuum coupling member 58, and gas coupling member 56. Screw driving system 10 may be used, for example, for driving threaded fasteners during the assembly process of HDDs.

Figure 2A:
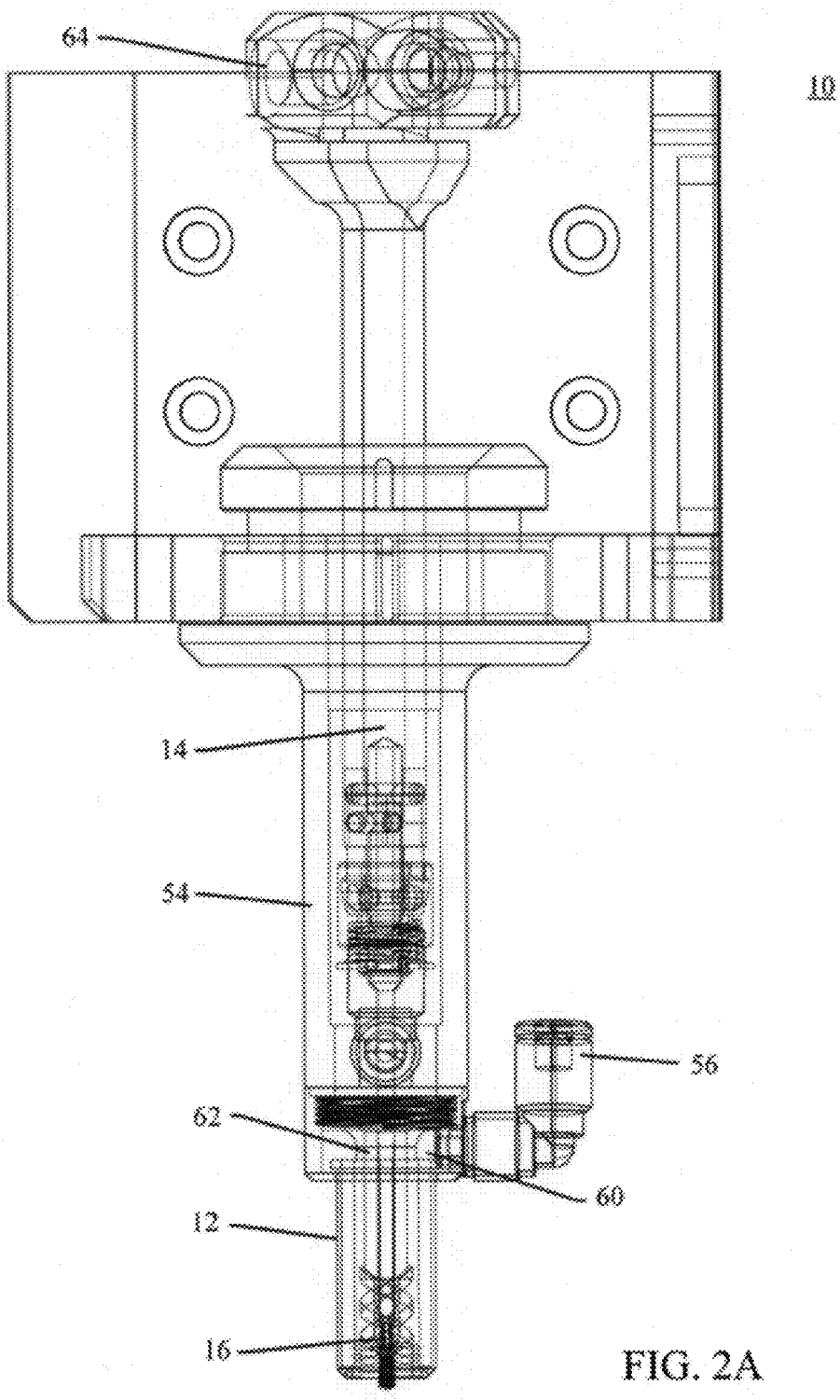
FIG. 2A illustrates a cross-sectional view of a screw driving system, in accordance with various aspects of the subject disclosure.

FIG. 2A illustrates a cross-sectional view of screw driving system 10, in accordance with various aspects of the subject disclosure. Screwdriver 14 is mounted within housing 54 and comprises bit 16 for driving a threaded fastener. Screw driving system 10 also comprises drive coupling member 64 to couple a shaft of screwdriver 14 to a mechanism (e.g., a motor) for rotating the shaft (and hence bit 16) for driving the threaded fastener. The mechanism may also apply an axial force to the shaft for driving the threaded fastener toward and into a workpiece. Housing 54 may include one or more bearings to support the rotation of the shaft. Housing 54 may also include one or more springs to apply a restorative force to the shaft to restore the axial position of the shaft after the axial force applied by the mechanism is released. Sleeve finder 12 is mounted to housing 54 and surrounds bit 16 while bit 16 is used to drive the threaded fastener. Gas coupling member 56 is mounted to housing 54 and is configured to attach to a compressed gas source (not shown) to supply a compressed gas to sleeve finder 12 via supply chamber 60 within housing 54. Vacuum coupling member 58 (e.g., shown in FIG. 1) is mounted to housing 54 and is configured to attach to a vacuum source (not shown) to apply a vacuum to sleeve finder 12 via vacuum chamber 62 within housing 54 for evacuating particles from sleeve finder 12.

Figure 2B:
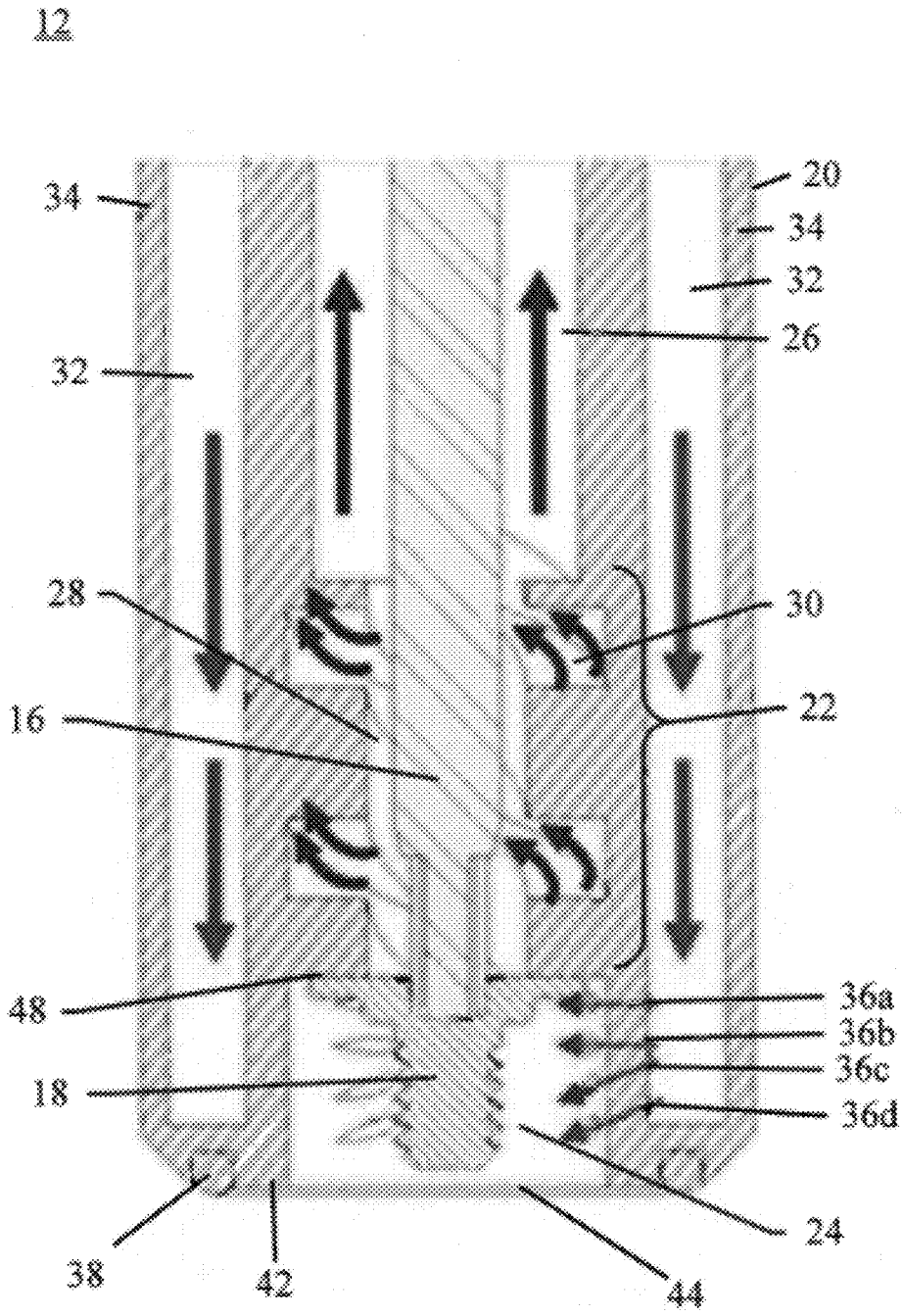
FIG. 2B illustrates a cross-sectional view of a screwdriver sleeve finder, in accordance with various aspects of the subject disclosure.

FIG. 2B illustrates a cross-sectional view of screwdriver sleeve finder 12, in accordance with various aspects of the subject disclosure. Sleeve finder 12 comprises sleeve 20 configured to be mounted on screwdriver 14 around bit 16 for driving threaded fastener 18. For example, bit 16 is rotatable and axially slidable with respect to sleeve 20 for driving threaded fastener 18 into a workpiece (e.g., a HDD component). Fastener stop 22 is disposed within sleeve 20 between forward bore 24 and rearward bore 26 of sleeve 20. Fastener stop 22 defines axial path 28 between rearward bore 26 and forward bore 24 for bit 16 to engage threaded fastener 18. The vacuum source (e.g., as described with respect to FIG. 2A) may apply a vacuum to forward bore 24 via vacuum coupling member 58, vacuum chamber 62, and rearward bore 26 (e.g., as illustrated by the arrows in rearward bore 26). In some aspects, fastener stop 22 is used for supporting threaded fastener 18 when the vacuum is applied. The vacuum applied may be sufficiently strong to hold threaded fastener 18 against fastener stop 22, for example when bit 16 is extended through axial path 28 and engaged with threaded fastener 18. Fastener stop 22 also defines evacuation path 30 between forward bore 24 and rearward bore 26. Evacuation path 30 provides a path for gas and/or particles from forward bore 24 to evacuate towards rearward bore 26 (e.g., as illustrated by the arrows within evacuation path 30). Thus, sleeve 20 may be coupled to the vacuum source for evacuating particles within forward bore 24 via evacuation path 30 and rearward bore 26.

Sleeve finder 12 also comprises a plurality of purge channels 32 defined within sidewalls 34 of sleeve 20. Compressed gas may be supplied into each channel 32 from the compressed gas source (e.g., as described with respect to FIG. 2A). Each channel 32 may direct the compressed gas (e.g., as illustrated by the arrows within channels 32) toward tip 42 of sleeve 20. Sleeve finder 12 also comprises a plurality of ports 36 (e.g., ports 36*a*, 36*b*, 36*c*, and 36*d*) disposed in sidewalls 34 of sleeve 20 to fluidly couple a channel 32 to forward bore 24. Thus, the compressed gas source (e.g., as described with respect to FIG. 2A) may supply a compressed gas into forward bore 24 via gas coupling member 56, supply chamber 60, the plurality of purge channels 32, and the plurality of ports 36.

According to various aspects of the subject disclosure, sleeve finder 12 facilitates the evacuation of contaminant particles generated while bit 16 is used to drive threaded fastener 18. For example, while bit 16 drives threaded fastener 18, the vacuum is applied to forward bore 24 for evacuating contaminant particles generated as a result of the abrasion between bit 16 and threaded fastener 18 and/or the abrasion between threaded fastener 18 and the workpiece that threaded fastener 18 is being driven into. Compressed gas is supplied into forward bore 24 via channels 32 and ports 36 to generate gas flow within forward bore 24 so that the gas and/or contaminant particles within forward bore 24 may be easily evacuated by the vacuum. For example, the compressed gas supplied into forward bore 24 may dislodge loose contaminant particles from bit 16, threaded fastener 18, and/or the workpiece so that the contaminant particles may flow into evacuation path 30 once the vacuum is applied. In some aspects, when the compressed gas is supplied into forward bore 24 and the vacuum is applied, a vortex is created within forward bore 24, allowing the contaminant particles to be easily evacuated through evacuation path 30.

According to certain aspects, ports 36 may be angled to direct the compressed gas in various directions within forward bore 24 to generate gas flow in different areas within forward bore 24. For example, a first set of ports (e.g., ports 36*a* and 36*b*) are angled to direct the compressed gas in a direction parallel to face 48 of fastener stop 22, which may be beneficial for generating gas flow around bit 16 and the head of threaded fastener 18 and for evacuating contaminant particles around this area. In another example, a second set of ports (e.g., ports 36*c* and 36*d*) are angled to direct the compressed gas in a direction away from face 48 of fastener stop 22. This may be beneficial for generating gas flow around a base of threaded fastener 18 and a surface of a workpiece that threaded fastener 18 is driven into, and for evacuating contaminant particles around this area. Ports 36 may be angled in any suitable direction to direct the compressed gas at a desired area within forward bore 24.

In some aspects, ports 36 may also be disposed in sidewalls 34 at different levels for directing the compressed gas at different areas within forward bore 24. For example, ports 36*a*, 36*b*, 36*c*, and 36*d* are disposed in sidewalls 34 at different levels. Port 36*a* is disposed at a level adjacent to face 48, which may be beneficial for generating gas flow around bit 16 and the head of threaded fastener 18 and for evacuating contaminant particles around this area. Port 36*d* is disposed at a level adjacent to opening 44 of forward bore 24 in tip 42 of sleeve 20. This may be beneficial for generating gas flow around a base of threaded fastener 18 and a surface of a workpiece that threaded fastener 18 is driven into, and for evacuating contaminant particles around this area. Ports 36*b* and 36*c* are disposed at levels between the levels at which ports 36*a* and 36*d* are disposed. Ports 36 may be disposed in sidewalls 34 at any suitable level to direct the compressed gas at a desired area within forward bore 24.

In some aspects, ports 36 are angled tangentially with respect to sidewalls 34 and evacuation path 30 comprises a helical passageway. In this regard, the compressed gas supplied into forward bore 24 may flow within forward bore 24 along sidewalls 34 and evacuate along the helical passageway when the vacuum is applied, creating a vortex within forward bore 24. Thus, contaminant particles within forward bore 24 are also evacuated according to the flow of the vortex. In some aspects, evacuation path 30 may comprise a double helical passageway or any other suitable helical arrangement to allow the gas and/or contaminant particles within forward bore 24 to evacuate through evacuation path 30 according to the flow of the vortex.

According to certain aspects, sleeve finder 12 also comprises sealing member 38 mounted to tip 42 of sleeve 20. Sealing member 38 surrounds opening 44 of forward bore 24. When sleeve finder 12 is used to drive threaded fastener 18 into a surface of an HDD component, for example, sealing member 38 may contact the surface and prevent gas and/or contaminant particles within forward bore 24 from escaping through opening 44. In some aspects, sealing member 38 may comprise a polyurethane O-ring, or other suitable mechanisms for sealing opening 44.

Figure 3:
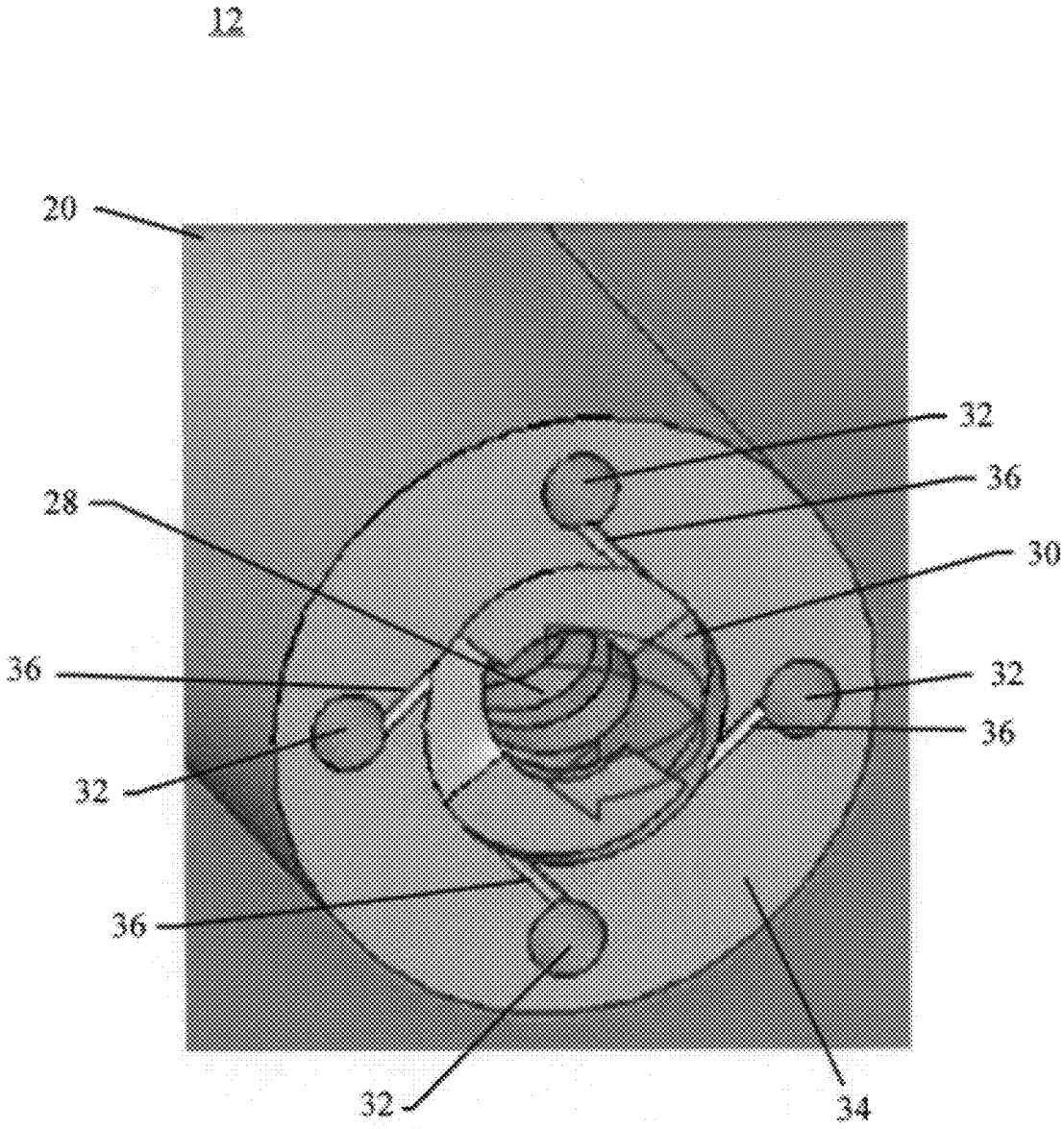
FIG. 3 illustrates a bottom cross-sectional view of screwdriver sleeve finder, in accordance with various aspects of the subject disclosure.

FIG. 3 illustrates a bottom cross-sectional view of screwdriver sleeve finder 12, in accordance with various aspects of the subject disclosure. Sleeve finder 12, as illustrated, comprises four purge channels 32. However, sleeve finder 12 may have more or less purge channels 32 depending on the size of sleeve finder 12, the amount of compressed gas to be supplied, the amount of contaminant particles to be evacuated, etc. FIG. 3 further illustrates four ports 36 coupling respective ones of the four purge channels 32 to forward bore 24. As shown in FIG. 3, ports 36 are angled tangentially with respect to sidewall 34 of sleeve 20 so that the compressed gas supplied into forward bore 24 flows along sidewall 34, helping to create a vortex as indicated by the arrow in FIG. 3. However, ports 36 may be angled at lesser degrees with respect to sidewall 34 provided that the compressed gas supplied into forward bore 24 flows along sidewall 34.

As illustrated in FIG. 3, ports 36 are disposed in sidewall 34 at the same level. Ports 36 are also equally spaced around a circumference of the level at which ports 36 are disposed in sidewall 34. This may be beneficial in ensuring that the compressed gas supplied into forward bore 24 is distributed equally around the circumference of forward bore 24. However, ports 36 may also be spaced around the circumference in different arrangements depending on the desired flow of compressed gas within forward bore 24.

Figure 4:
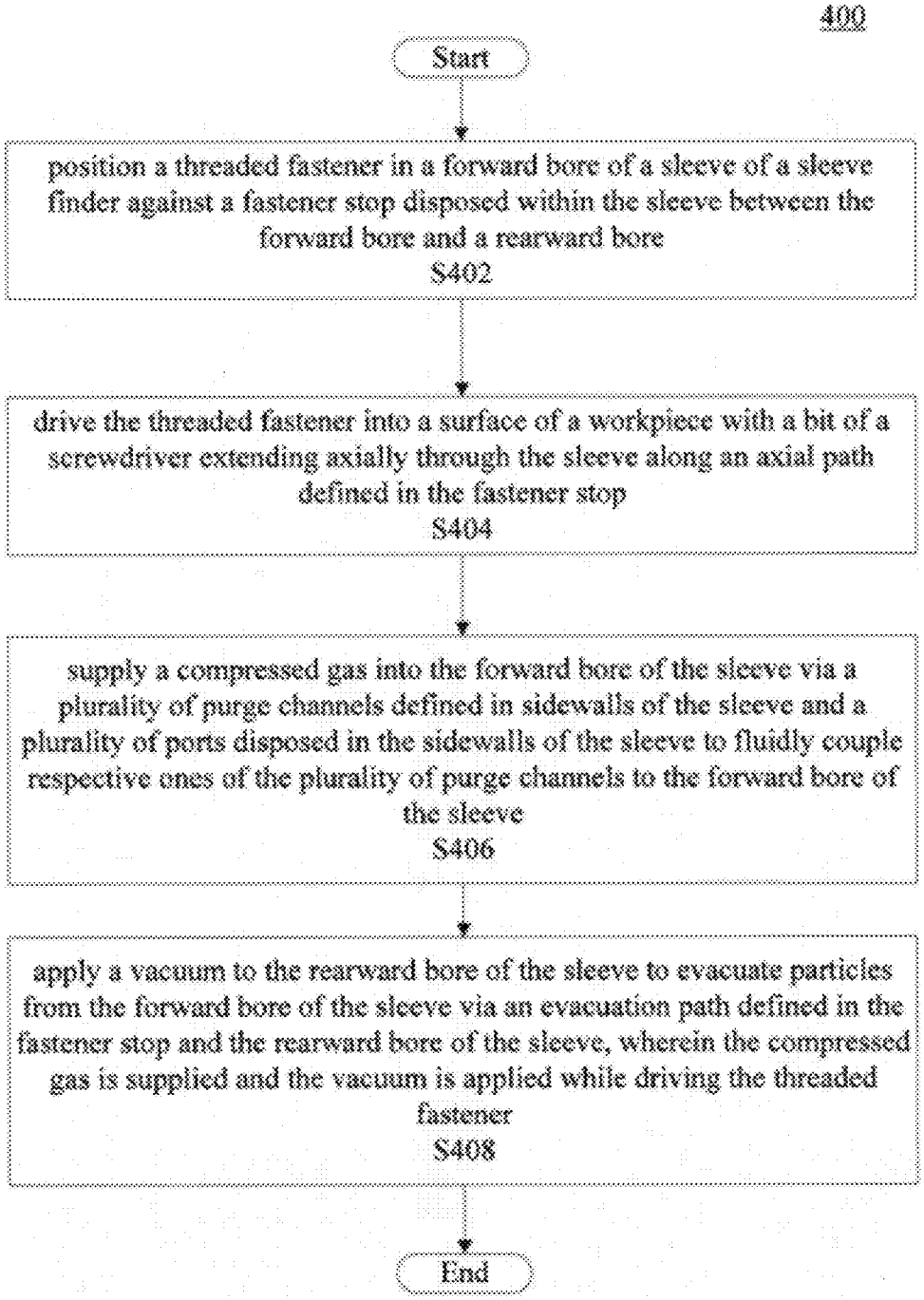
FIG. 4 illustrates an example of a method for evacuating particles while driving a threaded fastener, in accordance with various aspects of the subject disclosure.

FIG. 4 illustrates an example of method 400 for evacuating particles while driving threaded fastener 18, in accordance with various aspects of the subject disclosure. For example, method 400 may be implemented for driving threaded fastener 18 during an assembly process of an HDD. In some aspects, method 400 may be initiated when a particular workpiece is positioned to be operated on (e.g., an HDD component may be positioned for assembly in an assembly process) and one or more threaded fasteners are arranged for pick up by screw driving system 10 to drive the one or more threaded fasteners into the workpiece (e.g., an initialization process at the "Start" of method 400 before step S402 is executed). FIGS. 5A, 5B, 5C, and 5D illustrate cross-sectional views of screwdriver sleeve finder 12 corresponding to various steps of method 400 for evacuating particles while driving threaded fastener 18 into the workpiece, in accordance with various aspects of the subject disclosure.

Figures 5A, 5B, 5C, 5D:
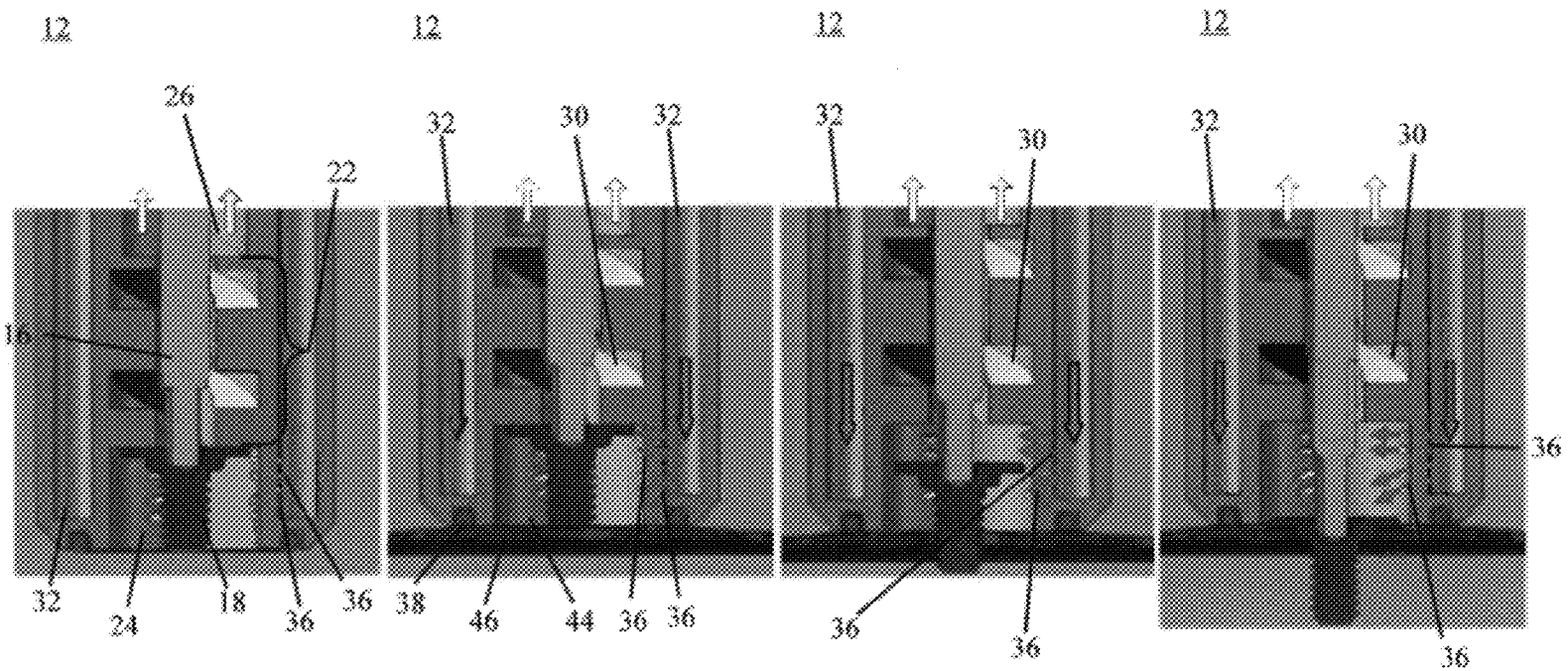
FIGS. 5A, 5B, 5C, and 5D illustrate cross-sectional views of a screwdriver sleeve finder corresponding to various steps of a method for evacuating particles while driving a threaded fastener, in accordance with various aspects of the subject disclosure.

In step S402 of method 400, threaded fastener 18 is positioned in forward bore 24 against fastener stop 22 between forward bore 24 and rearward bore 26. For example, screw driving system 10 may position sleeve finder 12 over threaded fastener 18 and lower sleeve finder 12 such that threaded fastener 18 is within forward bore 24 and is positioned against fastener stop 22 (e.g., as shown in FIG. 5A). Screw driving system 10 may position sleeve finder 12, along with threaded fastener 18 within forward bore 24, to surface 46 of the workpiece for driving threaded fastener 18 into surface 46 of the workpiece (e.g., as shown in FIG. 5B). In some aspects, sealing member 38 contacts surface 46 and prevents gas and/or contaminant particles within forward bore 24 from escaping through opening 44.

In step S404 of method 400, threaded fastener 18 is driven into surface 46 of the workpiece with bit 16 extending axially through sleeve 20 along axial path 28 defined in fastener stop 22. For example, bit 16 is rotatable and axially slidable with respect to sleeve 20. Thus, bit 16 may rotate and drive threaded fastener 18 into surface 46 (e.g., as shown in FIGS. 5B, 5C, and 5D).

In step S406 of method 400, a compressed gas is supplied into forward bore 24 via purge channels 32 (e.g., as shown in FIGS. 5B, 5C, and 5D by the arrows within channels 32) and ports 36 to fluidly couple respective ones of purge channels 32 to forward bore 24. In some aspects, ports 36 may be angled tangentially with respect to sidewalls 34 such that the compressed gas is supplied into forward bore 24 along sidewalls 34. Ports 36 may also be angled at different angles and/or disposed in sidewalls 34 at different levels in order to direct the compressed gas at different areas of threaded fastener 18. In some aspects, the compressed gas may be supplied into forward bore 24 at a pressure between about 0.18 bar and about 0.24 bar, which may be sufficiently strong to create gas flow within forward bore 24 so that the compressed gas and/or contaminant particles within forward bore 24 can be easily evacuated through evacuation path 30. However, the compressed gas may be supplied at a higher or lower pressure depending on the rate of gas flow that is desired within forward bore 24.

In some aspects, step S406 is implemented after step S404 begins implementation. For example, the compressed gas may be supplied into forward bore 24 after bit 16 begins driving threaded fastener 18 into surface 46. In some aspects, step S406 may be implemented immediately after sealing member 38 has contacted surface 46. Thus, step S406 may be implemented before or at the same time step S404 is implemented. For example, the compressed gas may be supplied into forward bore 24 before bit 16 drives threaded fastener 18 into surface 46. This may ensure that contaminant particles—generated, for example, as a result of the abrasion between bit 16 and threaded fastener 18 and/or the abrasion between threaded fastener 18 and surface 46—are immediately flowing within forward bore 24 as soon as they are generated.

In step S408 of method 400, a vacuum is applied (e.g., from the vacuum source as described with respect to FIG. 2A) to rearward bore 26 to evacuate particles from forward bore 24 via evacuation path 30 and rearward bore 26 (e.g., as shown in FIGS. 5B, 5C, and 5D by the arrows in rearward bore 26). In some aspects, evacuation path 30 comprises a helical passageway. Thus, if ports 36 are angled tangentially with respect to sidewalls 34, the compressed gas supplied into forward bore 24 may flow along sidewalls 34 and evacuate along the helical passageway once the vacuum is applied, creating a vortex within forward bore 24. In some aspects, the vacuum is applied at a pressure between about −0.3 bar and about −0.5 bar, which may be sufficiently strong to evacuate the compressed gas and/or contaminant particles within forward bore 24. However, the vacuum may be applied at a higher or lower pressure depending on the rate of evacuation that is desired.

In some aspects, step S408 is implemented after steps S404 and S406 begin. For example, the vacuum may be applied after bit 16 begins driving threaded fastener 18 into surface 46 and the compressed gas is supplied into forward bore 24. In some aspects, step S408 may be implemented before steps S404 and S406 begin and/or concurrently with steps S402, S404, and S406. For example, during step S402, the vacuum may be applied to forward bore 24 via vacuum chamber 62 and rearward bore 26, as illustrated by the arrows in rearward bore 26 in FIG. 5A. In some aspects, the vacuum applied may be sufficiently strong to hold threaded fastener 18 against fastener stop 22, for example when bit 16 is extended through axial path 28 and engaged with threaded fastener 18. While threaded fastener 18 is held against fastener stop 22 by the vacuum, screw driving system 10 may position sleeve finder 12, along with threaded fastener 18 within forward bore 24, to surface 46 of the workpiece. This vacuum applied during step S402 may be continually applied until and at the same time steps S404 and S406 are implemented. This may ensure that contaminant particles—generated, for example, as a result of the abrasion between bit 16 and threaded fastener 18 and/or the abrasion between threaded fastener 18 and surface 46—are immediately evacuated as soon as they are generated.

The foregoing description is provided to enable a person skilled in the art to practice the various configurations described herein. While the subject disclosure has been particularly described with reference to the various figures and configurations, it should be understood that these are for illustration purposes only and should not be taken as limiting the scope of the subject disclosure.

There may be many other ways to implement the subject disclosure. Various functions and elements described herein may be partitioned differently from those shown without departing from the scope of the subject disclosure. Various modifications to these configurations will be readily apparent to those skilled in the art, and generic principles defined herein may be applied to other configurations. Thus, many changes and modifications may be made to the subject disclosure, by one having ordinary skill in the art, without departing from the scope of the subject disclosure.

It is understood that the specific order or hierarchy of steps in the processes disclosed is an illustration of exemplary approaches. Based upon design preferences, it is understood that the specific order or hierarchy of steps in the processes may be rearranged. Some of the steps may be performed simultaneously. The accompanying method claims present elements of the various steps in a sample order, and are not meant to be limited to the specific order or hierarchy presented.

Terms such as "top," "bottom," "front," "rear" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. A phrase such an embodiment may refer to one or more embodiments and vice versa.

Furthermore, to the extent that the term "include," "have," or the like is used in the description or the claims, such term is intended to be inclusive in a manner similar to the term "comprise" as "comprise" is interpreted when employed as a transitional word in a claim.

The word "exemplary" is used herein to mean "serving as an example, instance, or illustration." Any embodiment described herein as "exemplary" is not necessarily to be construed as preferred or advantageous over other embodiments.

A reference to an element in the singular is not intended to mean "one and only one" unless specifically stated, but rather "one or more." The term "some" refers to one or more. All structural and functional equivalents to the elements of the various configurations described throughout this disclosure that are known or later come to be known to those of ordinary skill in the art are expressly incorporated herein by reference and intended to be encompassed by the subject disclosure. Moreover, nothing disclosed herein is intended to be dedicated to the public regardless of whether such disclosure is explicitly recited in the above description.

What is claimed is:

1. A screwdriver sleeve finder comprising:

a sleeve configured to be mounted on a screwdriver around a bit for driving a threaded fastener, wherein the bit is rotatable and axially slidable with respect to the sleeve;

a fastener stop disposed within the sleeve between a forward bore and a rearward bore of the sleeve for supporting the threaded fastener within the forward bore, wherein the fastener stop defines an axial path between the rearward bore and the forward bore for the bit to engage the threaded fastener and an evacuation path between the forward bore and the rearward bore;

a plurality of purge channels defined within sidewalls of the sleeve; and a plurality of ports disposed in the sidewalls of the sleeve to fluidly couple respective ones of the plurality of purge channels to the forward bore of the sleeve, wherein the sleeve is further configured to be coupled to a compressed gas source for supplying a compressed gas into the forward bore via the plurality of purge channels and the plurality of ports, and to be coupled to a vacuum source for evacuating particles within the forward bore via the evacuation path of the fastener stop and the rearward bore of the sleeve.

2. The sleeve finder of claim 1, further comprising a sealing member mounted to a tip of the sleeve, wherein the sealing member surrounds an opening of the forward bore in the tip of the sleeve.

3. The sleeve finder of claim 2, wherein the sealing member comprises a polyurethane O-ring.

4. The sleeve finder of claim 1, wherein the plurality of ports are angled tangentially with respect to the sidewalls of the sleeve.

5. The sleeve finder of claim 4, wherein at least one of the plurality of ports is further angled to direct the compressed gas in a direction parallel to a face of the fastener stop.

6. The sleeve finder of claim 4, wherein at least one of the plurality of ports is further angled to direct the compressed gas in a direction away from a face of the fastener stop.

7. The sleeve finder of claim 4, wherein the plurality of ports comprises:

a first set of ports equally spaced around a circumference of a first level of the sidewalls of the sleeve; and a second set of ports equally spaced around a circumference of a second level of the sidewalls of the sleeve, wherein the first level of the sidewalls of sleeve is adjacent to a face of the fastener stop and the second level of the sidewalls of the sleeve is adjacent to an opening of the forward bore in the tip of the sleeve.

8. The sleeve finder of claim 7, wherein the first set of ports are further angled to direct the compressed gas in a direction parallel to the face of the fastener stop and the second set of ports are further angled to direct the compressed gas in a direction away from the face of the fastener stop.

9. The sleeve finder of claim 8, wherein the sleeve finder comprises four purge channels, wherein the first set of ports comprises four ports coupling respective ones of the four purge channels to the forward bore of the sleeve, and wherein the second set of port comprises four ports coupling respective ones of the four purge channels to the forward bore of the sleeve.

10. The sleeve finder of claim 1, wherein the evacuation path defined in the fastener stop comprises a helical passageway.

11. The sleeve finder of claim 10, wherein the evacuation path defined in the fastener stop comprises a double helical passageway.

12. A method for evacuating particles while driving a threaded fastener, the method comprising:

positioning a threaded fastener in a forward bore of a sleeve of a sleeve finder against a fastener stop disposed within the sleeve between the forward bore and a rearward bore;

driving the threaded fastener into a surface of a workpiece with a bit of a screwdriver extending axially through the sleeve along an axial path defined in the fastener stop;

supplying a compressed gas into the forward bore of the sleeve via a plurality of purge channels defined in sidewalls of the sleeve and a plurality of ports disposed in the sidewalls of the sleeve to fluidly couple respective ones of the plurality of purge channels to the forward bore of the sleeve; and applying a vacuum to the rearward bore of the sleeve to evacuate particles from the forward bore of the sleeve via an evacuation path defined in the fastener stop and the rearward bore of the sleeve, wherein the compressed gas is supplied and the vacuum is applied while driving the threaded fastener.

13. The method of claim 12, wherein the compressed gas supplied into the forward bore of the sleeve forms a vortex.

14. The method of claim 13, wherein the compressed gas is supplied into the forward bore tangentially along the sidewalls of the sleeve in a direction parallel to a face of the fastener stop.

15. The method of claim 13, wherein the compressed gas is supplied into the forward bore tangentially along the sidewalls of the sleeve in a direction away from a face of the fastener stop.

16. The method of claim 12, wherein the evacuation path defined in the fastener stop is helical.

17. The method of claim 12, further comprising:

mounting the sleeve finder on the screwdriver around the bit of the screwdriver, wherein the bit is rotatable and axially slidable with respect to the sleeve finder;

coupling a compressed gas source to the plurality of purge channels defined within the sidewalls of the sleeve; and coupling a vacuum source to the rearward bore of the sleeve.

18. The method of claim 12, wherein the compressed gas is supplied into the forward bore of the sleeve at a pressure between 0.18 bar and 0.24 bar, and wherein the vacuum is applied to the rearward bore of the sleeve at a pressure between −0.3 bar and −0.5 bar.

19. A screw driving system comprising:

a housing;

a screwdriver mounted within the housing, wherein the screwdriver comprises a bit for driving a threaded fastener;

a sleeve finder mounted to the housing, the sleeve finder comprising:

a sleeve mounted around the bit of the screwdriver, wherein the bit is rotatable and axially slidable with respect to the sleeve;

a fastener stop disposed within the sleeve between a forward bore and a rearward bore of the sleeve for supporting the threaded fastener within the forward bore, wherein the fastener stop defines an axial path between the rearward bore and the forward bore for the bit to engage the threaded fastener and an evacuation path between the forward bore and the rearward bore;

a plurality of purge channels defined within sidewalls of the sleeve; and a plurality of ports disposed in the sidewalls of the sleeve to fluidly couple respective ones of the plurality of purge channels to the forward bore of the sleeve;

a first coupling member mounted in the housing, wherein the first coupling member is configured to attach to a compressed gas source to supply a compressed gas to the forward bore of the sleeve via a supply chamber within the housing, the plurality of purge channels defined in the sidewalls of the sleeve, and the plurality of ports disposed in the sidewalls of the sleeve; and a second coupling member mounted in the housing, wherein the second coupling member is configured to attach to a vacuum source to apply a vacuum to the rearward bore of the sleeve via a vacuum chamber within the housing for evacuating particles within the forward bore of the sleeve via the evacuation path defined in the fastener stop and the rearward bore of the sleeve.

20. The screw driving system of claim 19, wherein the sleeve finder further comprises a sealing member mounted to a tip of the sleeve, wherein the sealing member surrounds an opening of the forward bore in the tip of the sleeve.

21. The screw driving system of claim 19, wherein the plurality of ports of the sleeve finder comprises:

a first set of ports equally spaced around a circumference of a first level of the sidewalls of the sleeve; and a second set of ports equally spaced around a circumference of a second level of the sidewalls of the sleeve, wherein the first level of the sidewalls of sleeve is adjacent to a face of the fastener stop and the second level of the sidewalls of the sleeve is adjacent to an opening of the forward bore in the tip of the sleeve.

22. The screw driving system according to claim 21, wherein the first set of ports are angled tangentially with respect to the sidewalls of the sleeve to direct the compressed gas in a direction parallel to the face of the fastener stop, and the second set of ports are angled tangentially with respect to the sidewalls of the sleeve to direct the compressed gas in a direction away from the face of the fastener stop.

23. The screw driving system according to claim 19, wherein the evacuation path defined in the fastener stop comprises a helical passageway.

* * * * *